United States Patent [19]

Krammer et al.

[11] 4,406,430

[45] Sep. 27, 1983

[54] OPTICAL REMOTE CONTROL ARRANGEMENT FOR A PROJECTILE

[75] Inventors: Rudolf Krammer; Dietmar Stützle, both of Lauf; Harald Wich, Schwaig, all of Fed. Rep. of Germany

[73] Assignee: Diehl GmbH & Co., Nuremberg, Fed. Rep. of Germany

[21] Appl. No.: 217,814

[22] Filed: Dec. 18, 1980

[30] Foreign Application Priority Data

Dec. 22, 1979 [DE] Fed. Rep. of Germany ..... 2951941

[51] Int. Cl.[3] ..... F41G 7/26

[52] U.S. Cl. ..... 244/3.13

[58] Field of Search ..... 244/3.13, 3.11

[56] References Cited

U.S. PATENT DOCUMENTS

| | | | |
|---|---|---|---|
| 3,398,918 | 8/1968 | Girault | 244/3.13 |
| 3,860,199 | 1/1975 | Dunne | 244/3.13 |
| 4,174,818 | 11/1979 | Glenn | 244/3.13 |
| 4,300,736 | 11/1981 | Miles | 244/3.13 |

*Primary Examiner*—Charles T. Jordan

*Attorney, Agent, or Firm*—Scully, Scott, Murphy & Presser

[57] ABSTRACT

An optical remote control arrangement for a projectile, having provided for the guidance of the projectile from a firing base to a target, a sighting arrangement adapted for the sighting of the target along a sighting line. At least one light source is located at the firing base which emits a lamellar-shaped or finned light beam which upon traversing through at least one deflecting device periodically passes over a region containing the sighting line, wherein the light beam is directionally-dependently modulatable and detectable by at least one detector acting upon a demodulator and arranged on the projectile, by means of which control signals are generatable which act on the control devices of the projectile so as to exert an influence over the trajectory of the projectile. The optical remote control arrangement for a projectile has the light source (Laser) connected ahead of a modulator (MOD) sequentially generating pulse sequences of different pulse frequencies within a control period, and which controls the deflection device (ABL) as well as exciting the light source (Laser) for the emission of pusle frequency-modulated beams, through the detector (DT) of the demodulator (DEM) arranged in a projectile (G), consisting of a frequency measuring arrangement (FM), a programmable storage circuit (PROM) connected through the output thereof, and having connected therewith a decoder (DEC) which is associated with the control arrangement (STV).

19 Claims, 9 Drawing Figures

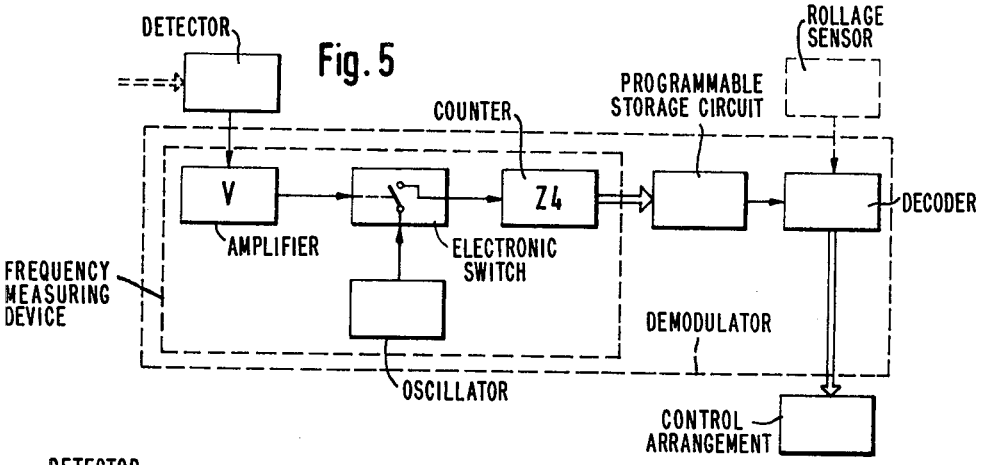
DETECTOR
Fig. 5
ROLLAGE SENSOR
PROGRAMMABLE STORAGE CIRCUIT
COUNTER
V
Z4
DECODER
AMPLIFIER
ELECTRONIC SWITCH
FREQUENCY MEASURING DEVICE
DEMODULATOR
OSCILLATOR
CONTROL ARRANGEMENT

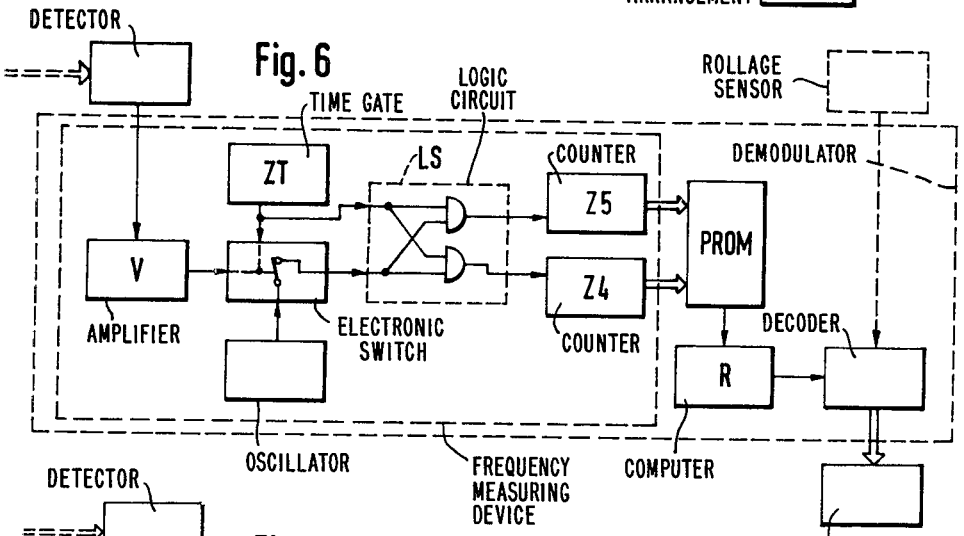
DETECTOR
Fig. 6
TIME GATE
LOGIC CIRCUIT
ROLLAGE SENSOR
ZT
LS
COUNTER
DEMODULATOR
Z5
PROM
V
Z4
AMPLIFIER
ELECTRONIC SWITCH
COUNTER
DECODER
R
OSCILLATOR
FREQUENCY MEASURING DEVICE
COMPUTER
CONTROL ARRANGEMENT

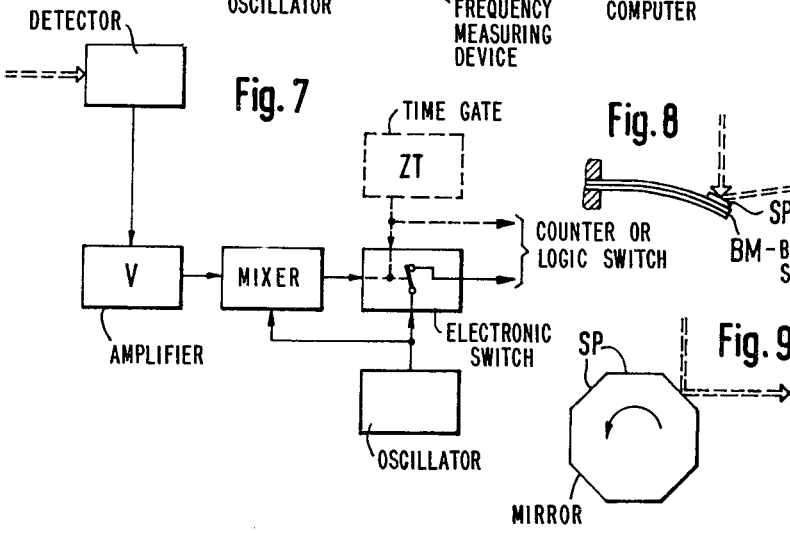
DETECTOR
Fig. 7
TIME GATE
ZT
COUNTER OR LOGIC SWITCH
V
MIXER
AMPLIFIER
ELECTRONIC SWITCH
OSCILLATOR

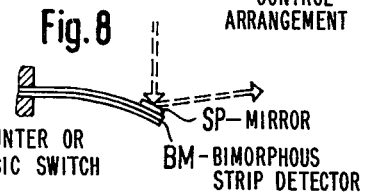
Fig. 8
SP-MIRROR
BM-BIMORPHOUS STRIP DETECTOR

SP
Fig. 9
MIRROR

OPTICAL REMOTE CONTROL ARRANGEMENT FOR A PROJECTILE

BACKGROUND OF THE INVENTION

1. Field of the Invention

The present invention relates to an optical remote control arrangement for a projectile, having provided for the guidance of the projectile from a firing base to a target, a sighting arrangement adapted for the sighting of the target along a sighting line. At least one light source is located at the firing base which emits a lamellar shaped or finned light beam which upon traversing through at least one deflecting device periodically passes over a region containing the sighting line, wherein the light beam is directionally-dependently modulatable and detectable by at least one detector acting upon a demodulator and arranged on the projectile, by means of which control signals are generatable which act on the control devices of the projectile so as to exert an influence over the trajectory of the projectile.

2. Discussion of the Prior Art

From German Pat. No. 14 81 990 there has become known an optical remote control arrangement for a projectile of the above-mentioned type. In a remote control arrangement of that kind no receiving or evaluating device is located at the firing base point for the waves which are reflected or transmitted from the projectile and, moreover, there are also not required any transmitting devices for a transmission of control signals to the projectile. Consequently, transmitting devices for the transmission of information to the firing base point are also not present in the projectile, so that there are reduced the overall requirements in comparison with other known devices. In the indicated German patent, a laser is utilized as the light source, whose electro-optically modulatable light is expanded lamellarly-shaped through anamorphatic installations, in particular, cylindrical lenses. Each of the lamellar-shaped light beams, by means of a pivoting mirror driven by a servomotor traverses a surface which contains the sighting line and the projectile. In accordance with the control of the servomotor is the light beam deflected in different directions. For the generation of a directionally-dependent modulatable light beam, these deflections of the light are synchronized with the frequency fluctuation of the modulated light beam so that each direction of a light beam corresponds to a predetermined value of the light modulation frequency. Within the projectile, connected to the light detectors are demodulators for the modulation given off for the lamellar-shaped light beam so that, due to the signals which are delivered by the demodulators, there are generated control signals which act upon the control arrangements.

In this known remote control arrangement it is disadvantageous that the optical modulation, deflection and focusing of the laser beam is only achieved through a considerable demand on optical components. For the control of the optical system of the firing base point, in this known German publication there is utilized a computation unit or, in effect, a programming unit. Arranged in the projectile as the complementary member is a detector and demodulating device which again acts on the guidance installation through a computer apparatus. Overall, the constructional requirement which is necessary, on the one hand, at the base station and, on the other hand, within the projectile, is considerable, so as to lead to high manufacturing costs. The utilization of that type of guidance installation for small projectiles is thus not possible.

SUMMARY OF THE INVENTION

Accordingly it is an object of the present invention to provide an optical remote control arrangement of the above described type, which can also be inexpensively incorporated in small-sized projectiles.

The foregoing object is achieved in a controllable optical remote control arrangements for a projectile of the type described wherein the light source (LASER) is connected ahead of a modulator (MOD) sequentially generating pulse sequences of different pulse frequencies within a control period, and which controls the deflection device (ABL) as well as exciting the light source (LASER) for the emission of pulse frequency-modulated beams, through the detector (DT) of the demodulator (DEM) arranged in a projectile (G), consisting of a frequency measuring arrangement (FM), programmable storage circuit (PROM) connected through the output thereof, and having connected therewith a decoder (DEC) which is associated with the control arrangement (STV).

The inventive optical remote control arrangement should, for example, find application in a projectile which is started through its own firing system, for instance, pursuant to the high-low pressure principle and which exits the firing tube at a relatively low initial velocity. Ignited at a safe distance from the firing elements is the propulsion drive engine and the projectile is accelerated to its maximum velocity. Immediately after the burning down of the propellant charge, there is determined the deviation or, in essence, the transverse velocity which is caused by initial error, thrust reactor error and cross wind by the directionally-dependent modulated laser beam. Through the triggering of a number of individual correcting drive units which are adequate to the cross impulse, which are located about the circumference of the projectile, there is achieved a compensation of the transverse velocity. For the reduction of the air resistance, thereafter, there can finally be separated the projective from the burnt out or spent drive unit and the projectile, can continue its path into the target with a low reduction in velocity.

In the herein described instance there occur only deviations in the horizontal plane. Vertical deviations can be corrected through spin stabilization.

In an advantageous embodiment of the invention, as the light source there can hereby be employed an externally triggerable semi-conductor laser diode with lamellar-shaped beam cross-section. The lengthier side of the lamellars shows for this horizontal correction in the vertical direction.

In an advantageous embodiment of the invention, each deflection unit consists of a pulse frequency-dependent controllable acoustic-optical laser deflector.

For increasing the precision of the electronic circuitry for the modulation and demodulation of the light beam, it is of particular advantage to utilize components from the digital electronic technology which can be effected monolithically, for example, in the CMOS technology. This inventive construction facilitates the utilization of the optical remote control arrangement even in small projectiles since the volumetric and energy requirement for those types of electronic circuits is extremely low.

An erroneous interpretation of the information contained in the directionally-dependent modulated light beam through the demodulator which is arranged within the projectile is prevented in that, inventively, in each of the beam directions there is transmissible an equal determinable number of pulses whose pulse frequency is variable in dependence upon the beam direction.

An inventive effectuation of demodulator for the recognition of the deviation of the projectile from the sighting line and for producing the control signal is also provided for by the invention.

The construction pursuant to the invention also provides the advantageous capability that the demodulator determines the cross velocity encountered perpendicular to the sighting line and processes corresponding control signals. This remote control arrangement which requires an amplified circuitry demand is adequate to even extremely high percision requirements.

BRIEF DESCRIPTION OF THE DRAWINGS

Reference may now be had to the following detailed description of exemplary embodiments of the invention, taken in conjunction with the accompanying drawings; in which:

FIG. 5 is an illustration of a demodulator for the recognition of the deviation of the projectile.

FIG. 6 is a schematic circuit block diagram for the recognition of the cross velocity of the projectile occuring perpendicular to the sighting line;

FIG. 7 is a further exemplary embodiment of an input wiring circuit for the demodulator for the recognition of the deviation, in essence, the cross velocity of the projectile pursuant to the embodiments of FIGS. 5 and 6;

FIG. 8 is a device formed of bimorphous strips for the deflection of the light beam; and FIG. 9 is a further deflection device for deflecting the light beam through the intermediary of a mirror wheel.

DETAILED DESCRIPTION

Figure 1:
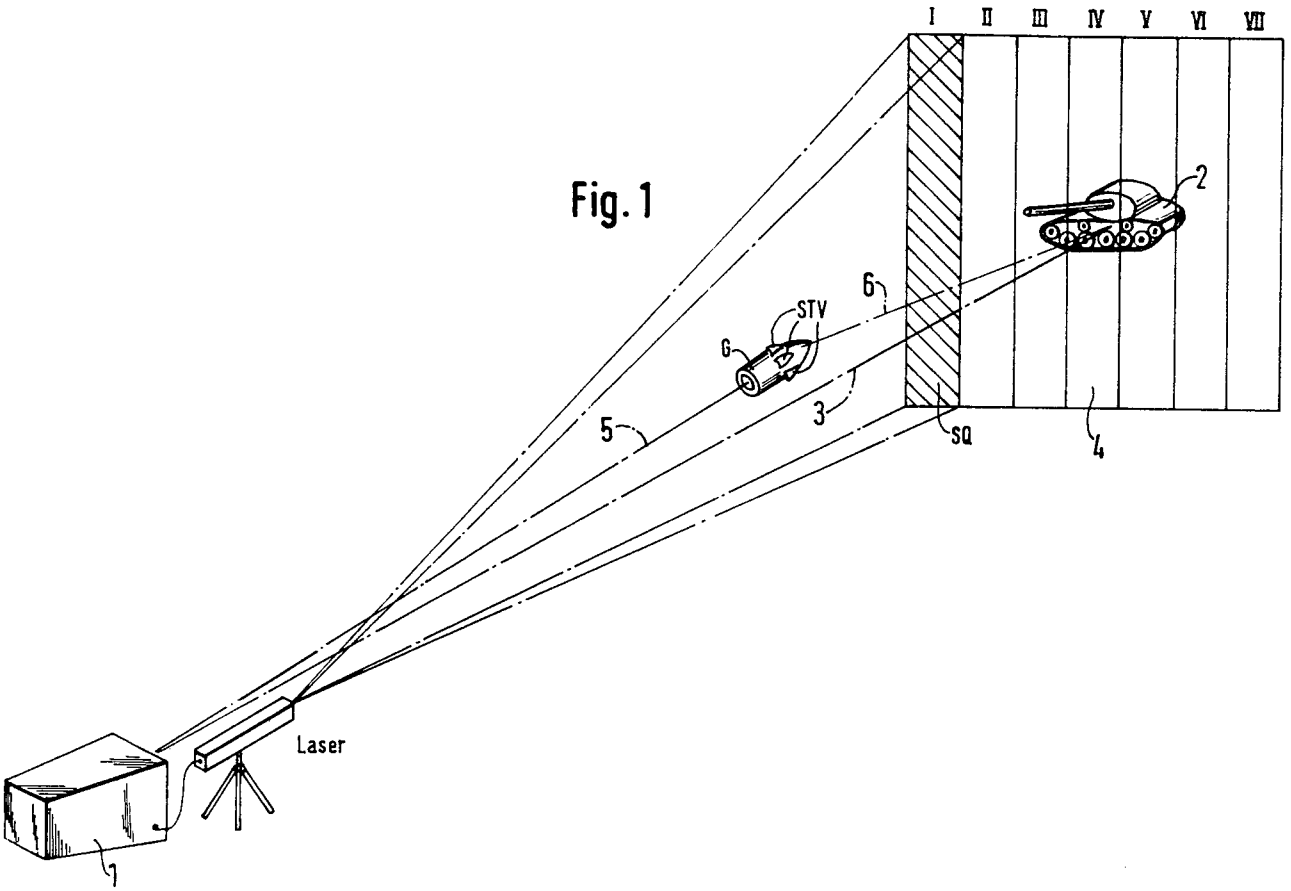
FIG. 1 illustrates a schematic representation of an optical remote control arrangement for a projectile.

In FIG. 1 there is schematically illustrated an optical remote control arrangement for a projectile. The firing base 1 contains a sighting device, not shown in detail herein, through the aid of which there can be sighted the target 2 along a sighting line 3. A LASER which is utilized as a light source, has a deflector installation, not shown in detail herein, connected ahead thereof, and transmits sequentially lamellar-shaped light beams having a beam cross-section SQ. These fin or lamellar-shaped light beams which are directed in a vertical direction, herein schematically designated with I-VII, illuminate a surface 4 which contains the target 2 and the sighting line 3. The sighting device on the firing base 1 and the LASER are connected with each other. A projectile G which is started from the firing base 1, after burning down of its propellant charge, registers the pulse-modulated LASER light, and under consideration of the rollage, transmits through a rollage sensor, not shown in detail herein, control signals to the control arrangements STV so that the uncorrected trajectory 5 is conveyed through a cross impulse into corrected trajectory 6 and, thereby, there is reached the target 2.

Figure 2:
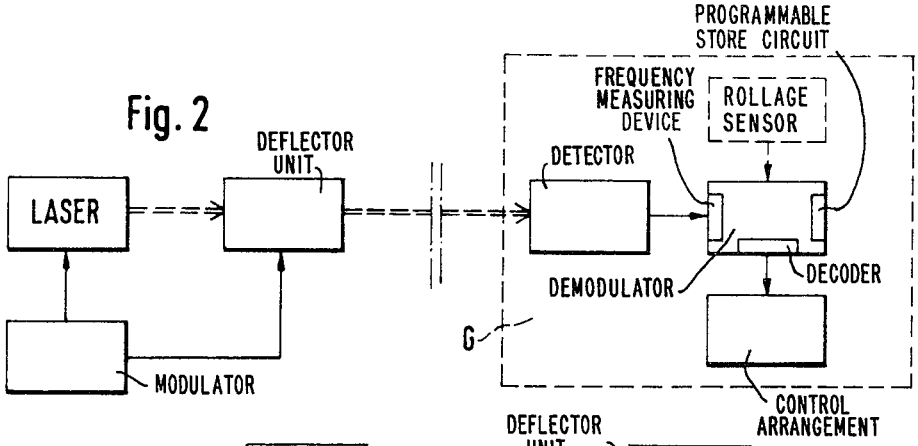
FIG. 2 is a circuit block diagram of an optical remote control arrangement.

FIG. 2 illustrates the optical and electronic components which are arranged on the firing base and, respectively, within the projectile, and which represent an optical remote control arrangement for a projectile pursuant to the invention. On the firing base, by means of a modulator MOD there is acted upon a LASER as well as upon a deflector arrangement ABL for the deflection of a light beam. Utilized herein as the light source in a preferred embodiment is an externally triggerable pulse laser, for example, a semiconductor laser diode with lamellar-shaped beam cross-section, whereby the light beam is directionally-dependent, pulse frequency-modulatable through the modulator MOD. The thus modulated laser light, through the herein not in detail illustrated optical components, will assist in the focusing and bounding of the light beam directed towards the deflecting device ABL which, controlled by the modulator MOD, will deflect the former in conformance with the pulse frequency of the incoming laser light about a predetermined angle so that is covered overall the surface 4 which is already described in FIG. 1. In the projectile G this pulse-modulated laser light impinges against the detector DET which acts on a demodulator DEM so that control signals can be transmitted to a control arrangement STV. In spin-stabilized projectiles, the demodulator DEM has additionally transmitted thereto information over the rollage through a rollage sensor RS. The demodulator DEM at its input contains a frequency measuring device FM which is connected with the detector DET and which determines the pulse frequency of the light beam and transmits it into a programmable storage circuit PROM contained in the demodulator DEM. The PROM determines from the introduced data the deviation of the projectile from the desired trajectory and further transmits this information to the decoder DEC which conveys control signals to the control arrangement STV.

Figure 3:
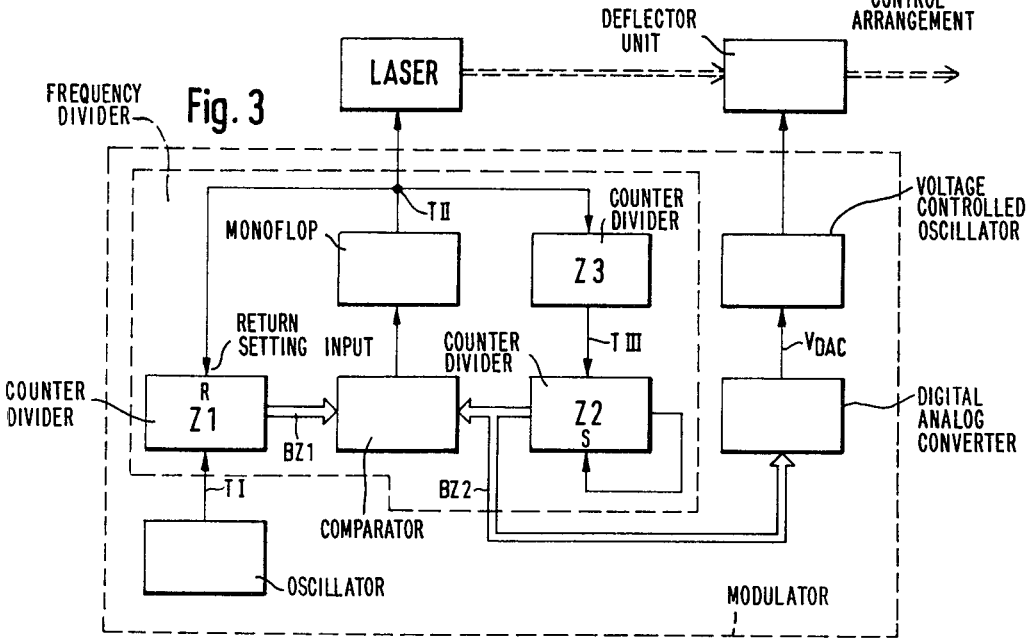
FIG. 3 is an exemplary embodiment of a modulator.

Illustrated in FIG. 3 is an inventive representation of the modulator MOD which controls the laser and the deflector unit ABL consisting of a pulse frequency-dependent controllable acoustic-optical laser deflector. The modulator MOD contains a frequency divider FT which is controllable from an oscillator OSZ 1 through synchronizing impulses T I and which produces the pulse sequences T II of variable pulse frequency and thereby acts on the LASER. Moreover, the frequency divider FT, for the control of the pulse frequency-dependent acoustic-optical laser deflector ABL generating voltage impulses corresponding to the binary encoded numbers BZ 2, which voltage impulses correspond to the actual current pulse frequency associated with a predetermined deflection, and which act on a digital-analog conveter DAC which generates at the output thereof a voltage $V_{DAC}$ proportioned to the binary encoded number, which controls a voltage-controlled oscillator VCO which is connected with the acoustic-optical LASER deflector ABL. The frequency divider FT contains three counter/dividers Z1, Z2 and Z3, as well as a comparator KOMP and a monoflop MF. The counter Z1 is supplied at its synchronizing input with synchronizing impulses T I of the oscillator OSZ 1. At start the counter Z 1 is set back through its return setting input R to the value zero through a suitable arrangement not described herein in detail. The counter now produces in the beat T I binary encoded numbers BZ 1 which, through corresponding binary voltage impulses, supply a comparison input of the comparator KOMP. The other comparison input of the comparator is supplied with voltage impulses of the counter Z 2 corresponding to the binary count BZ 2 which, in a similar manner as the counter Z 1, can be set back to the value two at start. This counter Z 2 is supplied at its synchronizing input with synchronizing impulses T 3 of a third counter Z 3 acting as a divider, whose synchronizing input is controllable through the synchronizing impulses T II of the monoflop MF. The input of this monoflop FM receives from the output of the comparator KOMP, at the equality of the two binary numbers BZ 1 and BZ 2, a signal which supplies at its output, in addition to the counter Z 3, also the return setting input R of the counter Z 1, as well as the control input of the LASER. The counter Z 3, upon the reaching of a settable value, is set back through its setting input S to the value two so that there can again be scanned the surface 4 (see FIG. 1).

Figure 4:
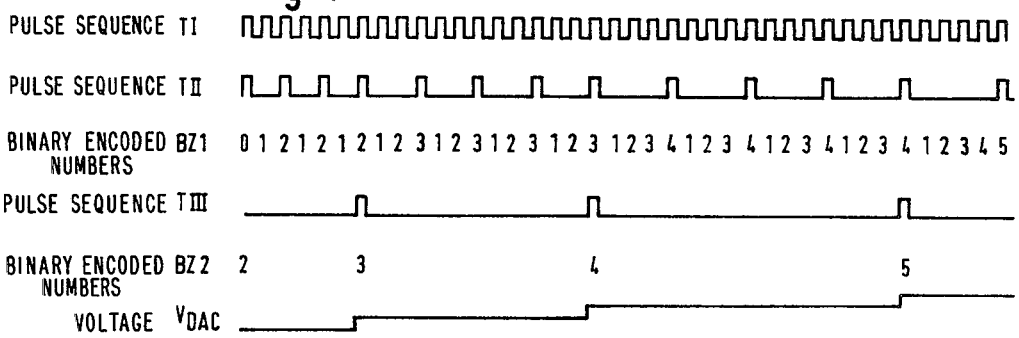
FIG. 4 is a representation of different voltages and binary numbers for an exemplary embodiment pursuant to FIG. 3.

In FIG. 4 there are illustrated the voltages T I, T III and $V_{DAC}$ occuring in FIG. 3, as well as the binary numbers BZ 1 and BZ 2 during the course of time. Hereby, the counter Z 3 is so utilized that it divides by four the impulse sequence T II, as can be ascertained at the output through the synchronizing impulses T III. The LASER presently obtains, pursuant to this example, four pulses of the same frequency which is obtained from the basic frequency, corresponding to the synchronizing impulses T I, after division of the binary count BZ 2. The digital-analog converter DAC converts this binary number BZ 2 into an analog voltage signal $V_{DAC}$ which, pursuant to FIG. 3, powers the voltage-controlled oscillator VCO which generates a frequency proportional to this voltage, and which is so selected that the LASER deflector ABL passes over the desired area (surface 4 in FIG. 1).

In FIG. 5 there is disclosed an inventive effectuation of the demodulator DEM which is arranged within the projectile G. This demodulator contains, in addition to the PROM and the decoder DEC, frequency measuring device FM, consisting of an electronic switch ES which is controllable by the detector DET through an amplifier V, through which a further oscillator OSZ 2 is connectable with a fourth counter Z 4, whereby the counter Z 4 at its output supplies the PROM which controls the decoder DEC, which for a spin-stabilized projectile is additionally controllable by the rollage sensor.

Illustrated in FIG. 6 is a demodulator DEM which is adequate for higher demands, which renders it possible to recognize the cross velocity of the projectile G occuring perpendicular to the sighting line 3 (see FIG. 1). The frequency measuring device FM, in this instance, in addition to the electronic components appearing in FIG. 5 includes a time gate ZT which supplies a further control input of the electronic switch ES, whereby the output of the electronic switch ES and the output of the time gate ZT supply a logic circuit, LS which consists of two interconnected dual AND gates, wherein each input of the logic circuit LS is connected with, respectively, an input of each dual AND gate, whose outputs supply two counters Z 4 and Z 5 which, at their output, control the programmable storage circuit PROM. The PROM is connected with a computer unit R which determines the cross velocity from the two different sequentially measured count conditions of the counters Z 4 and Z 5 through differential formation, and supplies the decoder DEC for the issuance of control signals to the control arrangement STV.

Besides the discontinuous modulation, at a continuous change in the deflection angle and corresponding continuous pulse frequency modulation of the light beam, there can be advantageously varied the input wiring circuit of the frequency measuring device FM in the type and manner indicated in FIG. 7. The continual change in the deflection angle, for example, can be carried out with the known possibilities illustrated in FIGS. 8 and 9. A continual change in the deflection angle, when a relatively slow traversal of a large angled area is desired, can be of advantage. In this instance, in a preferred embodiment, the amplifier V has a mixer MIX connected to the output thereof, whose second input is connected with a further oscillator OSZ 2 which generates at its output the difference or the sum of the two input frequencies. In a usual manner there is herein utilized the difference, and this frequency difference conducted to the control input of the electronic switch ES which, in the activated condition, connects the oscillator OSZ 2 with the counter circuit which is constructed pursuant to FIGS. 5 or 6.

FIG. 8 illustrates a bimorphous strip deflector arrangement BM combined from two piezo-ceramics which, upon the application of a possibly amplified electrical voltage (for example, $V_{DAC}$) generatable by the modulator MOD, will bend. Thereby it is possible to deflect the light beam by means of the adhered mirror SP.

Illustrated in FIG. 9 is a mirror wheel SR with mirrors SP which is suitable for the deflection of the light, which is a controllable pulse frequency-dependent from the modulator MOD through a stepping motor or through a synchronous motor.

This invention is not limited to the herein described example with only one corrective capability, for instance, in the horizontal direction. Naturally in amplification of electronic construction it is also possible to realize a further corrective capability, for example, in the vertical direction.

Hereby, for example, there can be modulated with different pulse frequencies, two lasers which. for instance, emit light of different wave lengths, and whereby the beams thereof can be directionally-dependently modulated by two different deflector arrangements. For the receipt of the two laser beams there can be uitlized two detectors in the projectile, which respond presently only to one wavelength of the current laser. However, there also consists the possibility of splitting the light beam of a dually modulatable laser through a laser divider into two part beams which are directionally-dependently modulatable from two different deflector devices. In this instance there can be utilized only one detector in the projectile, which has a demodulator connected to the output thereof recognizing the two modulations. Naturally, it is also possible to have combinations between the two herein presented solutions. In particular there can also be utilized a laser for deflection into two axis subsequent to each other (meaning, time-sequentially).

We claim:

1. In an optical remote control arrangement for a projectile; including sighting means for the sighting of a target along a sighting line so as to provide for the guidance of the projectile from a firing base to said target; at least one light source at the firing base emitting a lamellar-shaped light beam; deflecting means traversed by said light beam to cause said light beam to periodically pass over a region containing said sighting line; a demodulator on the projectile; at least one detector acting upon said demodulator, said light beam being directionally-dependently modulatable and detectable by said detector, said detector generating control signals acting on control devices on said projectile so as to influence the trajectory of said projectile; the improvement comprising: a modulator sequentially generating pulse sequences of different pulse frequencies within a control period, said light source being connected ahead of said modulator, said modulator controlling said deflecting means and exciting said light source for the emission of a pulse frequency-modulated beam, through the demodulator in the projectile across said detector, consisting of a frequency measuring arrangement; a programmable storage circuit, and a decoder connected therewith and associated with said control devices.

2. Optical remote control arrangement as claimed in claim 1, wherein said light source comprises an externally triggerable pulse laser.

3. Optical remote control arrangement as claimed in claim 2, said light source comprising a semiconductor laser diode with a lamellar-shaped beam cross-section.

4. Optical remote control arrangement as claimed in claim 1, said modulator including a frequency divider supplying an oscillator with synchronous impulses at the utilzation of only one deflecting means, said frequency divider generating pulse sequences of variable pulse frequency and thereby controlling the light source.

5. Optical remote control arrangement as claimed in claim 4, said deflecting means comprising a pulse frequency-dependently controllable acoustic-optical laser beam deflector.

6. Optical remote control arrangement as claimed in claim 5, wherein, for controlling of the pulse frequency-dependent deflecting means, said frequency divider has obtainable therefrom the current actual pulse frequency corresponding to a predetermined deflection through voltage impulses corresponding to binary encoded numbers, and associable with a digital-analog converter; and a voltage-controlled oscillator supplying the deflecting means being connected with the output of said converter.

7. Optical remote control arrangement as claimed in claim 6, said frequency divider comprising three counter/dividers, a monoflop and a comparator and wherein said first counter is supplied with the synchronous impulses of said oscillator, said first counter generating further voltage impulses corresponding to further binary encoded numbers and therewith supplies the comparator through which these are comparable with the voltage impulses corresponding to the binary encoded number generated from the second counter so that an output impulse produced at the output of the comparator at the equality of both binary encoded numbers controls the monoflop, an impulse being generatable at the output of said monoflop which controls the light source, a return setting input of the first counter settable back to an adjustable first number, and a synchronizing input of the third counter switched as a divider with an adjustable dividing relationship, wherein further synchronizing impulses are obtainable at the output of the third counter which controls the second counter whereby upon the reaching of an adjustable second count said second counter is settable through a setting input to an adjustable third number.

8. Optical remote control arrangement as claimed in claim 7, wherein an equal determinable number of pulses being transmissible in each beam direction, whose pulse frequency is variable in dependence upon the beam direction.

9. Optical remote control arrangement as claimed in claim 7 or 8, wherein said frequency measuring arrangement in said projectile includes an electronic switch controllable from said detector through an amplifier; a further oscillator being connectable through said switch with a fourth counter whereby the deviation of the projectile from the sighting line is registered by the programmable storage circuit and convertible by the decoder into control signals supplying the control device.

10. Optical remote control arrangement as claimed in claim 9, wherein said demodulator includes a timegate for recognizing a cross velocity of the projectile occuring perpendicular to the sighting line, said time gate controlling the electronic switch through a further control input of the latter; a logic circuit comprising two interconnected dual AND gates being controlled from one input thereof, the other input being connectable through the electronic switch with synchronizing impulses of the further oscillator wherein each input of the logic circuit is presently connected with one input of each dual AND gate whose outputs presently control two counters, said counters supplying with their respective binary encoded count conditions the programmable storage circuit whose output is connectable with a computer which supplies the decoder for the generation of the control signals.

11. Optical remote control arrangement as claimed in claim 10, comprising a mixer in said projectile connected intermediate said detector, the further oscillator and said electronic switch, through which there is generatable a differential signal formed through frequency mixing from a detector signal and a further oscillator signal, which controls the electronic switch.

12. Optical remote control arrangement as claimed in claim 4, comprising bimorphous strips for deflecting the light beam, said strips being controlled from said modulator.

13. Optical remote control arrangement as claimed in claim 4, comprising a mirror wheel for deflecting said light, said wheel being controllable from said modulator by a stepping motor.

14. Optical remote control arrangement as claimed in claim 1, said decoder having a further input connected with a rollage sensor.

15. Optical remote control arrangement as claimed in claim 13, said stepping motor including a tachometer-generator.

16. Optical remote control arrangement as claimed in claim 13, said stepping motor including an angle encoder.

17. Optical remote control arrangement as claimed in claim 4, comprising a mirror wheel for deflecting said light, said wheel being controllable from said modulator by a synchronous motor.

18. Optical remote control arrangement as claimed in claim 17, said synchronous motor including a tachometer-generator.

19. Optical remote control arrangement as claimed in claim 17, said synchronous motor including an angle encoder.

* * * * *